United States Patent [19]

Bieberbach et al.

[11] 4,249,593

[45] Feb. 10, 1981

[54] HEAT EXCHANGER WITH LEAK DETECTING DOUBLE WALL TUBES

[75] Inventors: George Bieberbach, Tampa; Donald J. Bongaards, Seminole; Alfred Lohmeier, Tampa; James M. Duke, St. Petersburg, all of Fla.

[73] Assignee: The United States of America as represented by the United States Department of Energy, Washington, D.C.

[21] Appl. No.: 4,634

[22] Filed: Jan. 19, 1979

[51] Int. Cl.[2] ..... F28F 9/02

[52] U.S. Cl. ..... 165/70; 165/158; 165/175

[58] Field of Search ..... 165/11, 70, 134, 140, 165/141, 158, 175

[56] References Cited

U.S. PATENT DOCUMENTS

| | | | |
|---|---|---|---|
| 2,365,515 | 12/1944 | Baudry | 165/70 |
| 2,743,089 | 4/1956 | Gardner et al. | 165/70 |
| 3,963,071 | 6/1976 | Levin et al. | 165/142 |
| 4,090,554 | 5/1978 | Dickinson | 165/70 |

FOREIGN PATENT DOCUMENTS

| | | | |
|---|---|---|---|
| 105926 | 11/1917 | United Kingdom | 165/70 |
| 730284 | 5/1955 | United Kingdom | 165/70 |
| 960628 | 6/1964 | United Kingdom | 165/70 |

*Primary Examiner*—Sheldon Richter

*Attorney, Agent, or Firm*—F. J. Baehr, Jr.

[57] ABSTRACT

A straight shell and tube heat exchanger utilizing double wall tubes and three tubesheets to ensure separation of the primary and secondary fluid and reliable leak detection of a leak in either the primary or the secondary fluids to further ensure that there is no mixing of the two fluids.

5 Claims, 5 Drawing Figures

HEAT EXCHANGER WITH LEAK DETECTING DOUBLE WALL TUBES

BACKGROUND OF THE INVENTION

This invention relates to heat exchangers, and more particularly, to a straight tube heat exchanger with double wall tubes and leak detecting means.

In liquid metal fast breeder reactors, liquid sodium from the reactors passes through an intermediate heat exchanger and transfers heat to a closed liquid sodium loop. The liquid sodium passing through the reactor becomes radioactive; however, it is not sufficiently radioactive to cause the liquid sodium in the closed loop to become radioactive. The non-radioactive liquid sodium in the closed loop is passed through a steam generator to produce steam which drives a turbine and generator to make electricity. The steam generator thus becomes a vital link in the system. Since sodium and water or steam when mixed result in a high energy release, it is imperative that possibility of a leak, which would result in the mixing of the sodium and water or steam, be minimized. Single wall tube steam generators have been plagued with leaks and have not been successful in keeping primary and secondary fluids apart even though rigorous inspection techniques have been developed.

SUMMARY OF THE INVENTION

In general, a heat exchanger for transferring heat from a primary fluid to a secondary fluid, when made in accordance with this invention, comprises a shell, a plurality of double wall tubes with at least one groove at the interface of the walls, a single tubesheet having a plurality of holes for receiving one end of the tube disposed on one end of the shell and a pair of generally parallel spaced apart tubesheets having a plurality of holes for receiving the tubes disposed on the other end of the shell. The tubes are so disposed in the shell and tubesheets that the outer wall of each tube terminates adjacent the inner tubesheet of the pair and the inner wall of each tube terminates adjacent the outer tubesheet of the pair. The shell has enlarged bulbous portions disposed adjacent each end thereof and extends into the bulbous portions, forming a double wall with a chamber between the walls. Foraminous collars are disposed between the chambers and the inner portion of the shell. Inlet and outlet primary fluid nozzles are disposed within the bulbous portion to cause the primary fluid to flow through the shell side of the heat exchanger. Heads are disposed on each end of the shell and cooperate with the tubesheets at each end of the shell to form headers for the tubes. One of the heads has an inlet nozzle for the secondary fluid and the other head has an outlet nozzle for the secondary fluid, which allow the secondary fluid to flow through the tubes and pick up heat from the primary fluid.

BRIEF DESCRIPTION OF THE DRAWINGS

The objects and advantages of this invention will become more apparent from reading the following detailed description in connection with the accompanying drawings, in which.

DESCRIPTION OF THE PREFERRED EMBODIMENT

Figure 1:
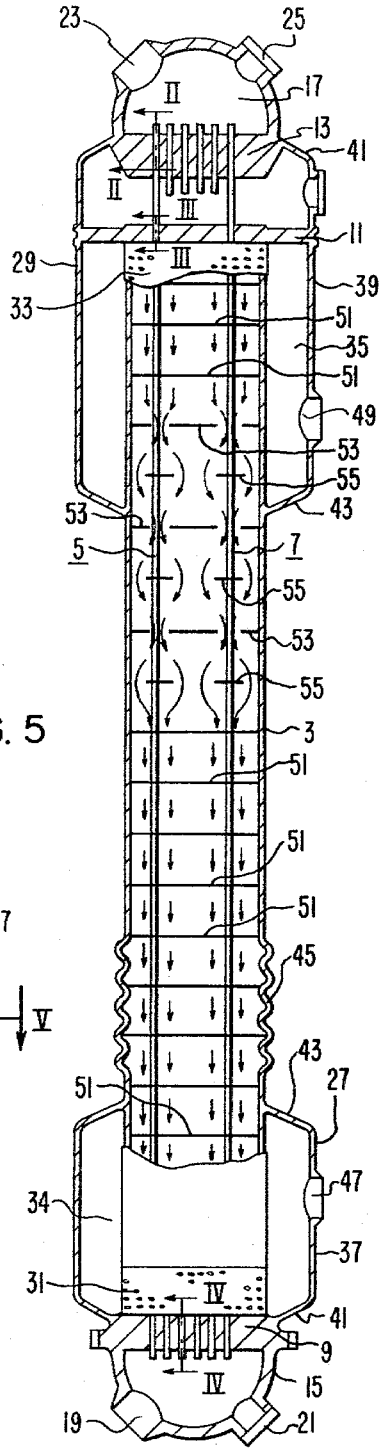
FIG. 1 is a sectional view of a heat exchanger made in accordance with this invention.

Referring now to the drawings in detail, and in particular to FIG. 1, there is shown a steam generator shell and tube heat exchanger 1 comprising a vertically oriented shell 3, a plurality of straight tubes 5 having double walls a and b and forming a tube bundle 7. A single tubesheet 9 is disposed on one end of the shell 3, the lower end and a pair of parallel spaced apart tubesheets 11 and 13 are disposed on the other end of the shell 3, the upper end. Hemispherical heads 15 and 17 are affixed to the tubesheets 9 and 13, respectively, forming headers at the ends of the tube bundle 7. A secondary fluid inlet nozzle 19 is disposed in the lower head 15 along with a manway 21 and a secondary fluid outlet nozzle 23 is disposed in the upper head 17 along with a manway 25.

The shell 3 is enlarged adjacent each end thereof, forming bulbous protrusions 27 and 29. The shell 3 extends into the bulbous portions 27 and 29 and terminates adjacent the tubesheets 9 and 11, providing a gap therebetween. Perforated or foraminous collars 31 and 33 fill the gap between the shell and the tubesheet providing a diffuser for the influent and effluent primary fluid as it enters and leaves the shell portion of the heat exchanger. The bulbous portions 27 and 29 and shell 3 provide chambers 34 and 35 for the influent and effluent primary fluid and cooperate with the foraminous collars 31 and 33 to ensure an equal flow distribution adjacent the tubesheets.

The bulbous portions 27 and 28 each have a cylindrical portion 37 and 39, respectively, and a pair of dished shaped portions 40 and 41, and 42 and 43 connecting the cylindrical portions 37 and 39 to the shell 3 and to the heads 9 or 13. The dished shaped portions 40 and 41, and 42 and 43 provide flexibility which allows for differential thermal expansion between the shell and the bulbous portions. To allow for differential expansion between the shell and the tubes an expansion device, such as a bellows 45, is disposed in the shell 3 adjacent the lower end thereof.

A primary fluid outlet nozzle 47 is disposed in the bulbous portion 27 and a primary fluid inlet nozzle 49 is disposed in the bulbous portion 29, allowing the primary fluid to enter the bulbous portion 29 and be distributed around the shell as it flows between the cylindrical portion 39 and the shell and enters the foraminous collar 33. The foraminous collar 33 diffuses the influent primary fluid as it enters the shell to ensure equal distribution to the entire tubesheet as the primary fluid enters the shell. A plurality of baffles 51, 53 and 55 are disposed within the shell to direct the primary fluid from the upper end of the shell to the lower end. The baffles 51 direct the primary fluid generally parallel to the tubes while the baffles 53 and 55 cooperate to provide a degree of cross flow of primary fluid with respect to the tubes. The baffles 51 are disposed adjacent each end of the shell, while the baffles 53 and 55 are disposed above the central portion of the tube bundle 7 to channel the primary fluid into predetermined areas to ensure acceptable mixing and result in generally even temperature profiles in the primary fluid in both the radial and axial directions. The foraminous collar 33 adjacent the tubeplate 9 cooperates with the bulbous portion 27 to ensure an even flow across the lower tubesheet 9.

Figure 2:
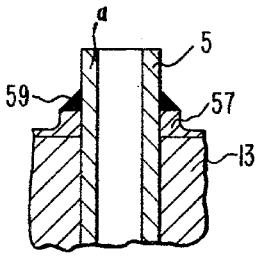
FIG. 2 is a partial sectional view taken on line II—II of FIG. 1.
Figure 5:
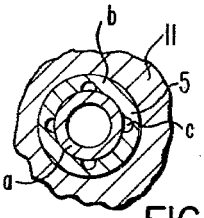
FIG. 5 is a partial sectional view taken on line V—V of FIG. 3.
Figure 3:
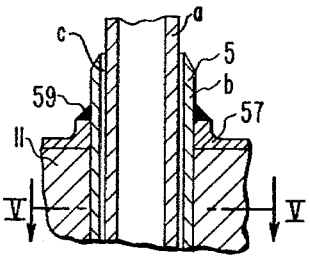
FIG. 3 is a partial sectional view taken on line III—III of FIG. 1.

The tubesheets 9 and 11 each have a boss or collar 57 extending upwardly around each hole in the tubesheet. The outer wall b of the tubes 5 terminates adjacent the upper side of the tubesheet 11 and a fillet weld 59 is disposed between the boss 57 and the outer wall b of the tubesheet, as shown in FIG. 3. The grooves c in the tubes 5 are in communication with the space between the tubesheets 11 and 13, as shown in FIG. 2 to provide leak detection for either primary or secondary fluid, which may incorporate the use of an inert fluid as a leak detecting medium.

The inner walls a of the tube 5 extend through the holes in the tubesheet 11 and terminate slightly above the bosses 57. A fillet weld 59 is disposed between the bosses 57 and the inner walls a of the tubes 5 to provide a seal weld between the head 17 and the space between the tubesheets 11 and 13.

Figure 4:
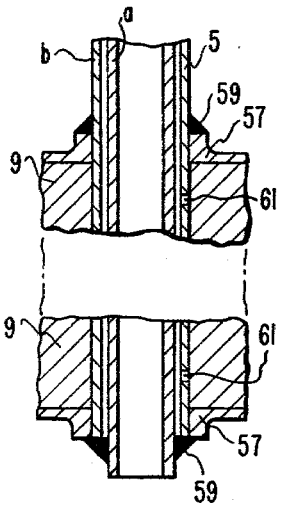
FIG. 4 is a partial sectional view taken on line IV—IV of FIG. 1.

As shown in FIG. 4, the lower tubesheet has bosses 57 around each hole on both sides of the tubesheet 9. The outer walls b of the tubes 5 terminate at the edge of the bosses 57, while the inner wall extends beyond the edge of the boss 57 and a fillet weld 59 is disposed between the end of the bosses 57 and the ends of the outer walls b and the inner wall a to form a seal weld between the head 15, the outer wall b and the tubesheet 9 to seal the groove c and form a seal between the inner and outer walls a and b. A fillet weld 59 is disposed between the edges of the bosses 57 on the upper side of the tubesheet 9 and the outer wall b of the tubes 5.

Holes 61 are disposed in the outer wall b of the tube 5 in communication with the grooves c, and in the portion of the tubes that are coextensive with the tubesheet 9 to provide leak detection for leaks which occur in the fillet welds 59.

The heat exchanger hereinbefore described is a straight tube and shell heat exchanger which, because of its simplicity, requires a minimal amount of fabrication operations, yet provides extremely high reliability to ensure the separation of the primary and secondary fluids. The space between the tubesheets 11 and 13 being in communication with the groove c at the interface of the tube walls a and b provides leak detection for either the primary or the secondary fluid to ensure that a leak of either primary of secondary fluid will not cause a mixture of the two fluids which would result in a high energy release.

What is claimed is:

1. A heat exchanger for transferring heat from a primary fluid to a secondary fluid, said heat exchanger comprising a shell, a plurality of double wall tubes with at least one groove at the interface of the two walls, a single tubesheet having a plurality of holes for receiving one end of the tubes disposed at one end of the shell, a pair of generally parallel spaced apart tubesheets having holes for receiving the other end of the tubes disposed at the other end of the shell, the outer wall of each tube terminating adjacent the inner tubesheet of said pair, the inner wall of said tubes terminating adjacent the outer tubesheet of said pair, the inner and outer wall of the said other end of said tubes terminating adjacent the outer edge of said single tubesheet, said shell having enlarged bulbous portions disposed adjacent each end thereof, said shell extending into said bulbous portions forming a double wall which produces chambers between said bulbous portions and said shell, foraminous collars disposed between said chambers and the inner portion of said shell, each bulbous portions having a nozzle for said primary fluid, one of said primary fluid nozzles being an inlet nozzle, the other being an outlet nozzle, a head disposed on each end of said shell, said heads cooperating with the tubesheets on each end of said shell to form a header for said tubes, one of said heads having an inlet nozzle for said secondary fluid, and the other head having an outlet nozzle for said secondary fluid.

2. A heat exchanger as set forth in claim 1 wherein the primary fluid nozzles are in communication with said shell through the bulbous portions.

3. A heat exchanger as set forth in claim 1, wherein the shell has an expansion joint disposed therein.

4. A heat exchanger as set forth in claim 1, wherein there is a boss extending from the tubesheets surrounding each hole and a fillet weld is disposed on the end of each boss and forms a seal weld with the tube.

5. A heat exchanger as set forth in claim 1 and further comprising a plurality of baffles disposed adjacent the tubesheets which direct the primary fluid generally longitudinally along the outer side of the tubes and a plurality of baffles disposed adjacent the central portion of the shell which cooperate to provide a degree of cross-flow of primary fluid with respect to the outer side of the tubes, the baffles and the foraminous collars cooperating to produce generally even temperature profiles in the primary fluid in both radial and axial direction and adjacent the tubesheets.

* * * * *